US005330032A

United States Patent [19]

Warner

[11] Patent Number: 5,330,032

[45] Date of Patent: Jul. 19, 1994

[54] LIFT TRUCKS AND EXTENSIBLE MAST STRUCTURES THEREFOR

[75] Inventor: Barry M. Warner, Winchester, United Kingdom

[73] Assignee: Linde Aktiengesellschaft, Fed. Rep. of Germany

[21] Appl. No.: 19,058

[22] Filed: Feb. 18, 1993

[30] Foreign Application Priority Data

Feb. 20, 1992 [GB] United Kingdom ..... 9203576

[51] Int. Cl.[5] ..... B66B 9/20

[52] U.S. Cl. ..... 187/9 E; 414/631

[58] Field of Search ..... 187/9 E, 9 R; 414/629, 414/630, 631

[56] References Cited

U.S. PATENT DOCUMENTS

| | | | |
|---|---|---|---|
| 2,582,999 | 1/1952 | Lehmann | 187/9 E |
| 2,883,003 | 4/1959 | Arnot | 187/9 E |
| 3,587,784 | 6/1971 | Tait | 187/9 E |

*Primary Examiner*—Kenneth W. Noland

*Attorney, Agent, or Firm*—Webb Ziesenheim Bruening Logsdon Orkin & Hanson

[57] ABSTRACT

An extensible mast structure having a fixed mast section and at least one movable mast section mounted on the fixed mast section. A load carrying carriage mounted on the movable mast section for vertical movement relative to the movable mast section. A primary jack connected to the movable mast section for moving the load carrying carriage and a secondary jack connected to the fixed mast section for moving the movable mast section to extend the mast structure. The relative operational cross-sectional areas of the primary jack and the secondary jack are selected to sequence movement of the primary jack to move the load carrying carriage before the secondary jack moves the movable mast section. A stop on the fixed mast section to engage a stop on the primary jack at an intermediate point in the stroke of the primary jack which permits the primary jack to assist the secondary jack and move the movable mast section during the remainder of its stroke while continuing to move the load carrying carriage and the secondary jack continues its stroke so that movement of the movable mast section is substantially uninterrupted.

13 Claims, 5 Drawing Sheets

LIFT TRUCKS AND EXTENSIBLE MAST STRUCTURES THEREFOR

BACKGROUND OF THE INVENTION

1. Field of the Invention

This invention relates generally to lift trucks and more particularly to an extensible mast structure for use on a lift truck.

More particularly, the invention relates to an extensible mast structure for an industrial lift truck. The mast structure includes a fixed mast section, at least one movable mast section mounted for vertical movement relative to the fixed mast section and a load carrying device which is vertically movable along the uppermost movable mast section. The extensible mast structure includes a lift arrangement for moving the load carrying device and for extending the mast structure.

2. Description of the Prior Art

It is known to provide a primary jack for moving a load carrying device along a movable mast, and a secondary jack for extending the mast structure. The two jacks have selected operational cross-sectional areas so that the primary jack is sequenced to raise the load carrying device before the secondary jack extends the mast structure. This means that full-free lift of the load carrying device is followed by the extension of the mast structure which continues to raise the load carrying device. Although there is no evident operational time lag between the end of the extension of the primary jack and the beginning of the extension of the secondary jack, in practice there is a jerk or hesitation in the upward movement of the load carrying device at the changeover from the operation of the primary jack to the operation of the secondary jack.

SUMMARY OF THE INVENTION

An object of the invention is to achieve a smooth changeover from the operation of the primary jack to the operation of the secondary jack to provide a substantially uninterrupted upward and downward movement of the load carrying device.

The invention provides a method of controlling the movements of an extensible mast structure on a lift truck. The mast structure includes a fixed mast section, at least one movable mast section mounted for vertical movement relative to the fixed mast section and a load carrying device which is vertically movable along the movable mast section and a lift arrangement comprising a primary jack for raising the load carrying device on the movable mast section and a secondary jack for raising the movable mast section to extend the mast structure. The two jacks have cross-sectional areas which are selected so that the primary jack raises the load carrying device on the movable mast structure before the secondary jack raises the movable mast section to extend the mast structure. The sequence of operation permits the secondary jack to begin its extension before the end of the operational stroke of the primary jack. This permits the remainder of the operational stroke of the primary jack to assist the secondary jack to extend the mast structure while continuing to raise the load lifting device relative to the movable mast section. The secondary jack thereafter completes its operational stroke.

The invention also provides means on the movable part of the primary jack adapted to engage a stop on the fixed mast section at an intermediate point in the stroke of the primary jack. This enables the primary jack, during the remainder of its stroke, to assist the secondary jack to extend the mast structure while continuing to raise the load lifting device relative to the movable mast section. The secondary jack thereafter continues to raise the movable section to extend the mast structure. Hydraulic jacks are preferred and the hydraulic fluid is initially supplied to the secondary jack which is connected in series to the primary jack.

The mast structure includes a fixed outer mast section, an intermediate mast section which is movable along the outer mast section, and an inner mast section which is movable along the intermediate mast section and which supports a load carrying device. The primary jack for raising the load carrying device is supported on the intermediate mast section and comprises a piston and cylinder arrangement. The piston operates downwardly up to an intermediate point in the stroke of the primary jack and the cylinder operates upwardly during the remainder of its stroke.

The secondary jack for extending the mast structure is supported on the outer mast section and comprises a piston and cylinder arrangement wherein the piston operates upwardly. Preferably the desired sequencing of the jacks is achieved by the piston of the primary jack having an effective cross-sectional area which is equal to or larger than the effective cross-sectional area of the piston of the secondary jack.

The primary jack has an associated tension member for raising the load carrying device. The tension member is fixed at one end to the fixed mast section and at its other end to the load carrying device and passes around a pulley mounted on the distal end of the piston rod of the primary jack. A yoke is attached to the pulley on the distal end of the end of the piston rod of the primary jack for engagement with a stop means on the fixed mast section. The yoke extends beyond the pulley in the direction of extension of the piston rod.

The fixed mast section is a pair of upright members interconnected by transverse horizontal bracing struts. The stop means on the fixed mast section is located on one of the horizontal bracing struts.

A complete understanding of the invention will be obtained from the following description when taken in connection with the accompanying drawings wherein like reference characters identify like parts throughout.

DESCRIPTION OF THE PREFERRED EMBODIMENT

Figure 1:
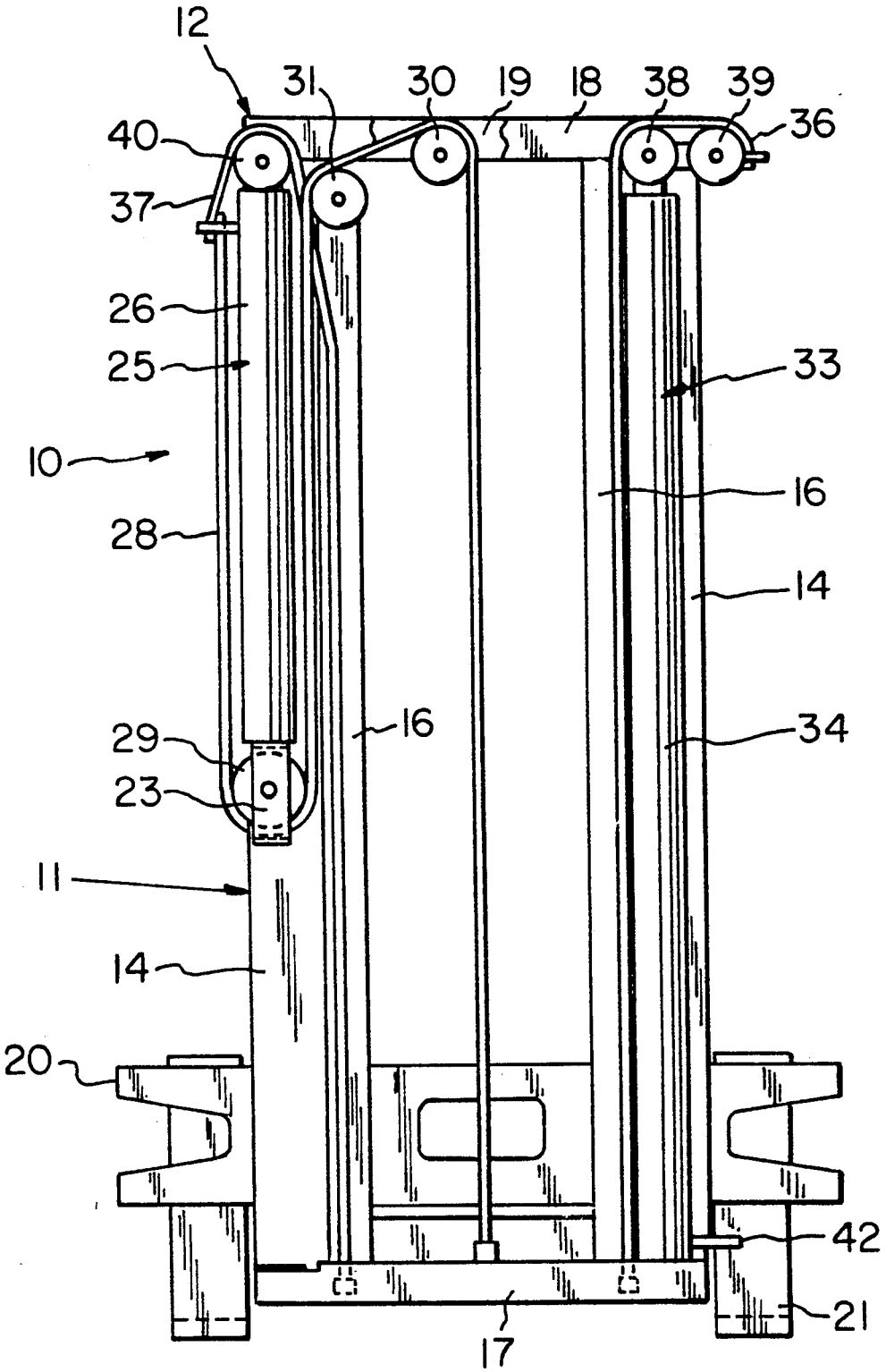
FIG. 1 is an elevation of a triple mast structure for a lift truck with the load carrying device in the lower position.

The mast structure shown in the drawings is adapted to be mounted on the forward end of the body of an industrial lift truck which has a forward facing operator's seat. The lift truck body is supported on ground wheels, at least one of which is driven by an electric motor mounted on the body. The lift truck is well known in the art and is not described further.

The drawings show an extensible mast structure 10 having an outer mast section 11, an intermediate mast section 12 and an inner mast section 13. Mast sections 11, 12 and 13 are of approximately equal length and are partially nested together to form a compact unit. Each mast section includes a pair of spaced vertical upright members 14, 15 and 16, respectively, which are connected at their upper and lower ends by horizontal bracing struts 17, 18 and 19, respectively. Outer mast section 11 is mounted on the truck body and the intermediate and inner mast sections 12 and 13 are, respectively, mounted for relative vertical movement on the outer and intermediate sections. A load lifting carriage 20 having load supporting forks 21, or another type of load carrying device, is mounted for vertical movement along inner mast section 13. For this purpose, intermediate mast section upright members 15 and inner mast section upright members 16 are I-sections and intermediate upright members 15 carry rollers 22 which run in outwardly facing channels of upright members 16. Similarly, carriage 20 carries rollers (not shown) which run in inwardly facing channels of inner upright members 16. Outer upright members 14 have inwardly facing channels and carry rollers 24 which run in outwardly facing channels of intermediate upright member 15. Alternatively, outer upright members 14 may have an I-section like the intermediate upright members and the inner upright members.

A primary hydraulic jack 25 has a cylinder 26 and a downwardly extending piston rod 27 for raising load lifting device 20. The upper end of cylinder 26 is bolted to left-hand upright member 15 of intermediate mast section 12 as shown in FIG. 1 of the drawings. Primary jack 25 is thereby supported vertically on the mast structure in a position which is offset from the longitudinal axis of the mast structure and is substantially aligned with the associated upright member 15. The primary jack is located laterally outwardly of the sight angle of the truck operator who is seated between the mast upright members.

A flexible tension member 28 such as a chain or cable is fixed at one end to the left-hand upright member 14 of outer mast section 11. The tension member passes under a pulley 29 on the lower end of piston rod 27 and over a pulley 30 on horizontal bracing strut 19 at the upper end of inner mast section 13. The other end of cable 28 is fixed to the center of load lifting carriage 20. Cable 28 passes over an intermediate pulley 31 mounted on horizontal bracing strut 18 at the upper end of intermediate mast section 12. Pulley 31 is located between pulleys 29 and 30 so that the effective path of cable 28 is displaced from the left-hand upright member 15 of intermediate mast section 12 to the center of carriage 20 while being maintained substantially vertical. This arrangement permits cable 28 to apply a pulling force on carriage 20 which, during operation of primary hydraulic jack 25 to raise the carriage, substantially counterbalances the downward force applied by the primary jack.

Figure 5:
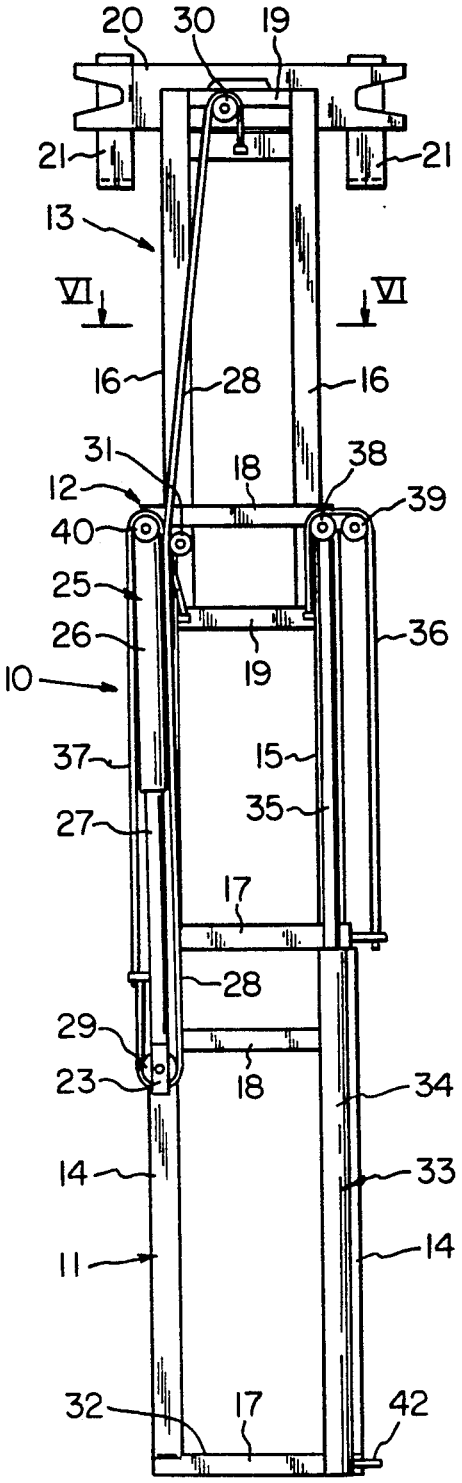
FIG. 5 is an elevation of the mast structure shown in FIG. 1 fully extended.

A secondary hydraulic jack 33 for extending the mast is provided on the side of the mast structure opposite primary jack 25. This secondary jack has a cylinder 34 and an upwardly extending piston rod 35. The upper end of cylinder 34 is bolted to the right-hand upright member 14 of outer mast section 11 and, as shown in FIG. 5 of the drawings, has a stroke length substantially equal to the full height of the outer mast section. The secondary hydraulic jack 33 is substantially aligned with the right-hand outer mast upright member 14. Secondary jack 33 is mounted in a position which is offset from the longitudinal axis of the mast structure and is located laterally outwardly of the sight angle of the truck operator.

Spaced tension members such as chains or cables 36 and 37 are arranged on opposite sides of the mast structure. One end of right-hand cable 36, as shown in FIG. 1 of the drawings, is connected to the top of outer mast section 11 and the other end is connected to the bottom of inner mast section 13. Cable 36 extends over a pair of adjacent pulleys 38 and 39 which are mounted in series on horizontal bracing strut 18 at the upper end of intermediate mast section 12. Pulley 38 is also mounted at the top of piston rod 35 of secondary jack 33 so that extension of the secondary jack will create a direct lifting force on intermediate mast section 12. The purpose of the second pulley 39 is to displace the effective path of cable 36 outwardly relative to secondary jack 33 to counterbalance the upward force applied by the secondary jack to lift the intermediate mast section. A similar effect could be achieved by replacing pulley 38 on the piston rod 35 with a larger diameter pulley.

A cable 37 follows a similar path on the left-hand side of the mast structure as shown in FIG. 1 of the drawings, but only requires a single pulley 40 of the same diameter as pulley 38. Pulley 40 is mounted on horizontal bracing strut 18 at the upper end of the intermediate mast section.

It will be understood by those skilled in the art that the joint pulling force of cables 36 and 37 to raise the inner mast section is substantially equally displaced on opposite sides of the longitudinal axis of the mast structure.

Figure 6:
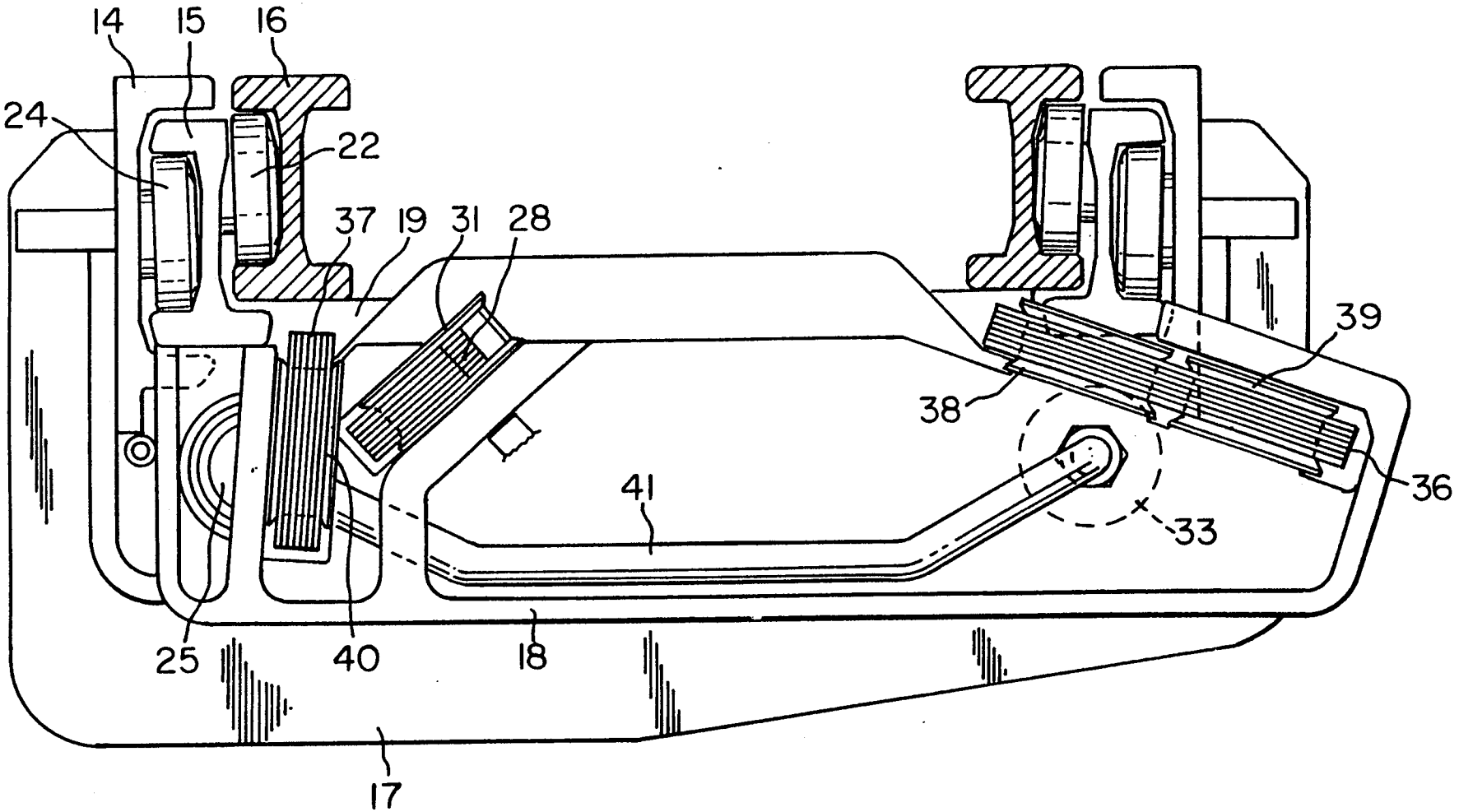
FIG. 6 is a section along live VI—VI in FIG. 5.

Jacks 25 and 33 are connected in series to a common supply of hydraulic fluid under pressure by a pipe 42 which is connected to the lower end of cylinder 34 of secondary jack 33. The hydraulic fluid flows vertically upwardly through piston rod 35 of secondary jack 33 and laterally through a connection pipe 41 as shown in FIG. 6 of the drawings to the upper end of cylinder 26 of primary jack 25. Piston rod 27 of primary jack 25 has an effective cross-sectional area which is equal to or larger than the effective cross-sectional area of piston rod 35 of secondary jack 33 for sequencing the operation of the two jacks to ensure that the primary jack is extended first.

Figure 2:
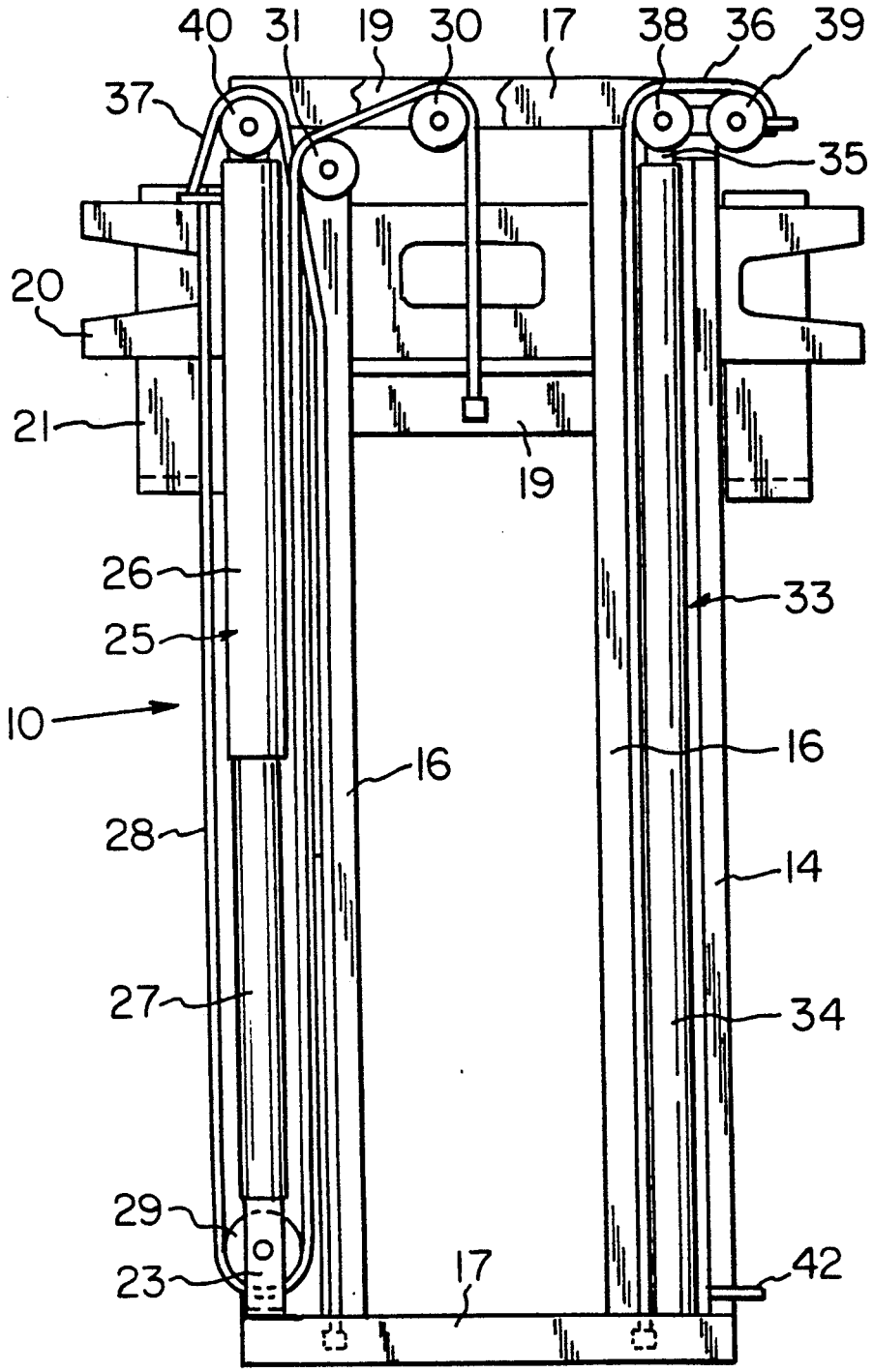
FIG. 2 is an elevation of the mast structure shown in FIG. 1 with the primary jack extended downwardly into engagement with the stop means on the fixed mast and before any extension of the secondary jack.
Figure 3:
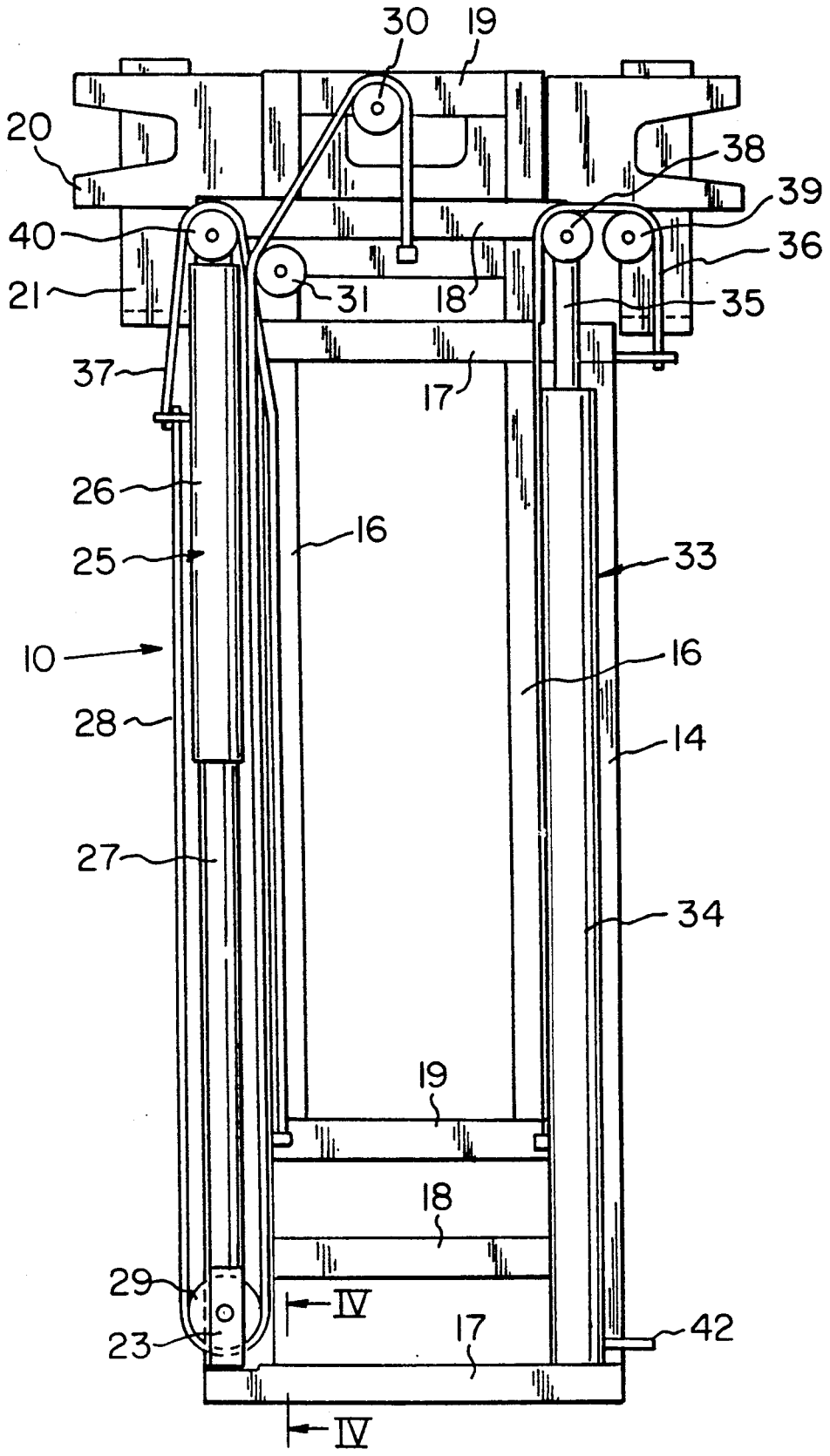
FIG. 3 is an elevation of the mast structure shown in FIG. 1 with the primary jack fully extended and the secondary jack partly extended.
Figure 4:
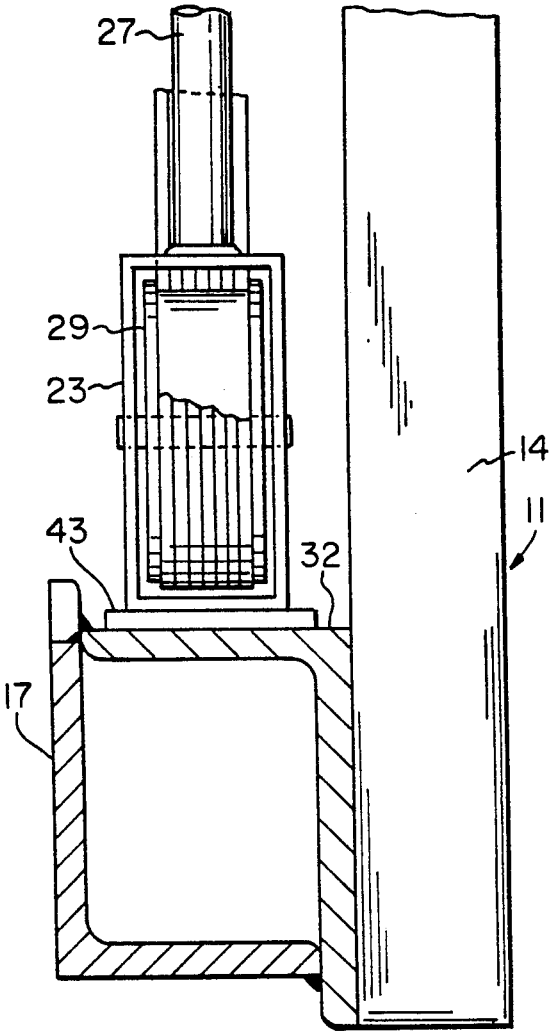
FIG. 4 is a section on line IV—IV of FIG. 3.

The above described mast structure is known to those skilled in the art. The feature provided by the mast structure of the invention is mounting pulley 29 on the free end of piston rod 27 of primary jack 25 by a shroud or yoke 23 which extends downwardly beyond the pulley, i.e., in the direction of extension of the jack, for engagement with the upper surface 32 of horizontal bracing strut 17 at the bottom of outer mast section 14 as shown in FIG. 2 of the drawings before load lifting carriage 20 is fully raised on the inner mast section. As shown in FIG. 4 of the drawings, horizontal bracing strut 17 is constructed as a box and a pad 43 of a plastic material, such as polyurethane, is attached to the upper surface 32 of the horizontal bracing strut to minimize noise when yoke 23 engages the horizontal bracing strut. Horizontal bracing strut 17 thus functions as a temporary stop means for the extension of primary jack 25 which has the effect of allowing the hydraulic fluid pressure to cause secondary jack 33 to extend the mast structure. This condition occurs at an intermediate point in the stroke of piston rod 27 of primary jack 25, whereby as secondary jack 33 begins to extend the mast structure, yoke 23 remains in engagement with pad 43 on surface 32. The continued extension of primary jack 25 to complete its stroke, through upward movement of cylinder 26, assists secondary jack 33 to extend the mast structure while further raising load lifting carriage 20 into its uppermost position on the inner mast as shown in FIG. 3 of the drawings. When primary jack 25 is fully extended, secondary jack 33 continues to extend, in a normal manner, until the mast structure is fully raised to the position shown in FIG. 5 of the drawings. The primary jack raises with intermediate mast section 12. This overlap in operation of the two jacks minimizes interruption or jerky upward movement of load lifting carriage 20.

When the mast structure is being extended, the off-center force of secondary jack 33 on intermediate mast section 12 is partially counterbalanced by the outwardly displaced force of cable 36 on the same side of the mast structure as secondary jack 33 to raise the inner mast section. Similarly, during the raising of load lifting carriage 20, the off-center action of primary jack 25 is transmitted by cable 28 to the center of load lifting carriage 20. Hence, the illustrated arrangement of cables 28, 36 and 37 combine with the asymmetrically mounted jacks 25 and 33 to provide a mast structure to provide an acceptable out of balance condition.

Reverse operation of secondary jack 33 will contract the mast structure until yoke 23 again engages pad 43 on horizontal bracing strut 17 at the lower end of outer mast section 11. Both jacks 25 and 33 will then contract together to return to the position shown in FIG. 2 of the drawings followed by full contraction of primary jack 25 to lower load lifting carriage 20 to the position shown in FIG. 1 of the drawings. Again the overlap in operation of the two jacks minimizes any interruption or jerky downward movement of load lifting carriage 20.

The invention is not limited to the specific details of the embodiment described hereinabove. For example, the mounting of jacks 25 and 33 and the associated chains, cables or other tension members may be reversed so that secondary jack 33 is on the left-hand side of the mast structure and primary jack 25 is on the right-hand side of the mast structure as shown in the drawings.

While a specific embodiment of the invention has been described in detail herein, it will be appreciated by those skilled in the art that various modifications and alternatives to the embodiment could be developed in light of the overall teachings of the disclosure. Accordingly, the particular arrangement is illustrative only and is not limiting as to the scope of the invention which is to be given the full breadth of the appended claims and any and all equivalents thereof.

I claim:

1. An extensible mast structure for a lift truck comprising a fixed mast section, at least one movable mast section mounted on said fixed mast section for vertical movement relative to said fixed mast section and a load carrying carriage mounted on said at least one movable mast section for vertical movement relative to said at least one movable mast section, a primary jack including a movable part, means operatively connecting said movable part to said load carrying carriage for moving said load carrying carriage relative to said movable mast section, a secondary jack connected to said fixed mast section and to said at least one movable mast section for moving said at least one movable mast section relative to said fixed mast section to extend said extensible mast structure, said primary jack and said secondary jack having relative operational cross-sectional areas selected to sequence the stroke of said primary jack to raise said load carrying carriage before the beginning of the stroke of said secondary jack to move said at least one movable mast section to extend said extensible mast structure, stop means on said fixed mast section and means carried by said movable part of said primary jack for engaging said stop means on said fixed mast section at an intermediate point in the stroke of said primary jack to thereby enable said primary jack to assist said secondary jack to move said at least one movable mast section to extend said extensible mast structure during the remainder of the stroke of said primary jack while continuing to raise said load carrying carriage relative to said at least one movable mast section, and said secondary jack continues its stroke to extend said extensible mast structure; whereby said movement of said at least one movable mast section to extend said extensible mast structure is substantially uninterrupted.

2. A mast structure as set forth in claim 1, wherein said primary jack and said secondary jack are hydraulic jacks.

3. A mast structure as set forth in claim 2, including a hydraulic fluid supply means connected to said secondary jack and subsequently connected in series with said primary jack.

4. A mast structure as set forth in claim 3, including an intermediate mast section mounted on said fixed mast section movable relative to said fixed mast section, and wherein said at least one movable mast section is an inner mast section movable along said intermediate mast section and supporting said load carrying carriage.

5. A mast structure as set forth in claim 2, including an intermediate mast section mounted on said fixed mast section movable relative to said fixed mast section, and wherein said at least one movable mast section is an inner mast section movable along said intermediate mast section and supporting said load carrying carriage.

6. A mast structure as set forth in claim 1, including an intermediate mast section mounted on said fixed mast section movable relative to said fixed mast section, and wherein said at least one movable mast section is an inner mast section movable along said intermediate mast section and supporting said load carrying carriage.

7. A mast structure as set forth in claim 6, wherein said primary jack for raising said load lifting carriage is a cylinder mounted on said intermediate mast section and a piston rod extending from said cylinder, wherein said piston rod moves downwardly until it contacts said stop means at said intermediate point in said stroke of said primary jack and said cylinder moves upwardly during the remainder of the stroke of said primary jack.

8. A mast structure as set forth in claim 6, wherein said secondary jack for extending said extensible mast structure is supported on said outer mast section and comprises a piston rod and cylinder arrangement.

9. A mast structure as set forth in claim 8, wherein each of said primary jack and said secondary jack has a cylinder and a piston rod extending from said cylinder, and the desired sequencing of the stroke of said primary jack and said secondary jack is achieved by providing said piston rod of said primary jack with an effective cross-sectional area at least equal to the effective cross-sectional area of said piston rod of said secondary jack.

10. A mast structure as set forth in claim 1, including a tension member attached for raising said load carrying carriage, said tension member having a first end fixed to said fixed mast section and a second end fixed to said load carrying carriage, and a pulley mounted on said movable part of said primary jack, whereby said tension member passes over said pulley.

11. A mast structure as set forth in claim 10, wherein said means carried by said movable part of said primary jack for engagement with said stop means on said fixed mast section is a yoke attached to said pulley and extending beyond said pulley in the direction of movement of said primary jack.

12. A mast structure as set forth in claim 1, wherein said fixed mast section is a pair of upright members having upper and lower ends, a horizontal bracing strut connecting each of said upper ends of said upright members, a horizontal bracing strut connecting each of said lower ends of said upright members and said stop means on said fixed mast section is located on said horizontal bracing struts connecting said lower ends of said upright members.

13. A method of controlling the movement of an extensible mast structure for a lift truck, said mast structure including a fixed mast section, at least one movable mast section mounted on said fixed mast section and a load carrying carriage movable along said movable mast section, a primary jack for moving said load carrying carriage relative to said at least one movable mast section and a secondary jack for moving said movable mast section relative to said fixed mast section to extend said extensible mast structure, said two jacks having operational cross-sectional areas selected to sequence the operation of said primary jack to move said load carrying carriage before the movement of said secondary jack to extend said extensible mast structure, said method comprising initiating the stroke of said primary jack to move said load carrying carriage relative to said movable mast section, initiating the stroke of said secondary jack to move said movable mast section relative to said fixed mast section to extend said extensible mast structure before the completion of said stroke of said primary jack to move said at least one movable mast section relative to said fixed mast section to extend said extensible mast structure, and thereafter completing said stroke of said primary jack to assist the stroke of said secondary jack to move said movable mast section relative to said fixed mast section to extend said extensible mast structure while simultaneously continuing to move said load lifting carriage relative to said extensible mast structure during the completion of said stroke of said primary jack to provide substantially uninterrupted movement of said at least one movable mast section relative to said fixed mast section during the extension of said extensionable mast structure.

* * * * *